US007837532B2

(12) United States Patent
Reuter

(10) Patent No.: US 7,837,532 B2
(45) Date of Patent: Nov. 23, 2010

(54) CHASSIS FOR A TRACK-GUIDED TOY VEHICLE

(75) Inventor: Uwe Reuter, Althengstett (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 270 days.

(21) Appl. No.: 11/335,611

(22) Filed: Jan. 20, 2006

(65) Prior Publication Data

US 2006/0172659 A1 Aug. 3, 2006

(30) Foreign Application Priority Data

Jan. 21, 2005 (DE) ..... 10 2005 002 882

(51) Int. Cl.
*A63H 17/00* (2006.01)

(52) U.S. Cl. ..... 446/444; 446/465

(58) Field of Classification Search ..... 446/444, 446/432, 446; 463/58, 61, 62, 63
See application file for complete search history.

(56) References Cited

U.S. PATENT DOCUMENTS 4,159,126 A 6/1979 Raleigh
4,221,077 A * 9/1980 von Winckelmann ..... 446/446
4,283,074 A * 8/1981 Tidwell ..... 280/124.103
4,795,154 A * 1/1989 Lahr ..... 104/242
2005/0106993 A1 * 5/2005 Fosbenner et al. ..... 446/432

FOREIGN PATENT DOCUMENTS

DE 7005169 U1 6/1970
DE 10 2004 011 934 A1 9/2005

* cited by examiner

*Primary Examiner*—Gene Kim
*Assistant Examiner*—Michael D Dennis

(57) ABSTRACT

A chassis is provided for a track-guided toy vehicle which is supported on a front axle and a rear axle and has a guide wedge that is movable about a first vertical pivot axle and cooperates with a groove in the raceway. The rear axle is driven by an electric motor, with the rear axle and the electric motor together forming an assembly. Steering capability of the vehicle, is optimized by arranging the assembly to be movable about a second vertical pivot axle. The assembly is operatively connected via a control unit to the chassis-mounted guide wedge.

4 Claims, 4 Drawing Sheets

CHASSIS FOR A TRACK-GUIDED TOY VEHICLE

CROSS-REFERENCE TO RELATED APPLICATIONS

This application is related to U.S. application Ser. No. 11/335,614 filed in Jan. 20, 2006, based on German Application No. 10 2005 002 612.5 filed in Germany on Jan. 20, 2005 and to U.S. application Ser. No. 11/335/576 filed on Jan. 20, 2006, based on German Application No. 10 2005 002 883.7 filed on Jan. 21, 2005.

BACKGROUND AND SUMMARY OF THE INVENTION

The present invention relates to a chassis for a track-guided toy vehicle having a front axle and a rear axle and a guide wedge which is movable about a first vertical pivot axle and cooperates with a groove in the raceway in the front area of the chassis, whereby the rear axle is driven by an electric motor, the rear axle and the electric motor together forming an assembly.

A toy vehicle described in unpublished DE 10 2004 011 934.1 and has a chassis with a front axle and a rear axle. A guide wedge is mounted in front of the front axle, rotatable about a pivot axle running perpendicular to the chassis and cooperating with a groove in a track for the toy vehicle. An electric motor used to drive the toy vehicle is installed in the chassis adjacent to the rear axle but between the front axle and the rear axle.

German Utility Model DE 7005169 U1 describes a toy car for operation on a track comprising an axle with non-driven wheels. The wheels are arranged to be steerable over the track.

U.S. Pat. No. 4,159,126 describes a model race car having a chassis with a front axle and a rear axle. The front axle is steerable, and the rear axle is supported on the chassis via a suspension system.

An object of the present invention is to provide a chassis for a track-guided vehicle that is optimized with regard to steering properties through suitable measures.

This object has achieved by providing that the assembly is movable about a second vertical pivot axis and is operatively connected to the chassis-mounted guide wedge via a control unit.

Among main advantages achieved with the present invention include the fact that through the cooperation of the assembly with the guide wedge via the control unit, a controlled steering performance of the toy vehicle on the track is achieved, thereby increasing the interest and pleasure in playing with the toy vehicle. In a first embodiment, the control unit is formed by a gear transmission and lever mechanism having four articulated joints which ensure a functionally reliable kinematic transfer of angular movements between the assembly and the guide wedge. The lever mechanism and gear transmissions that are implementable with a justifiable effort can be accommodated easily in the chassis. This is logically also true of a second embodiment of a control unit having a lever mechanism with five articulated joints.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
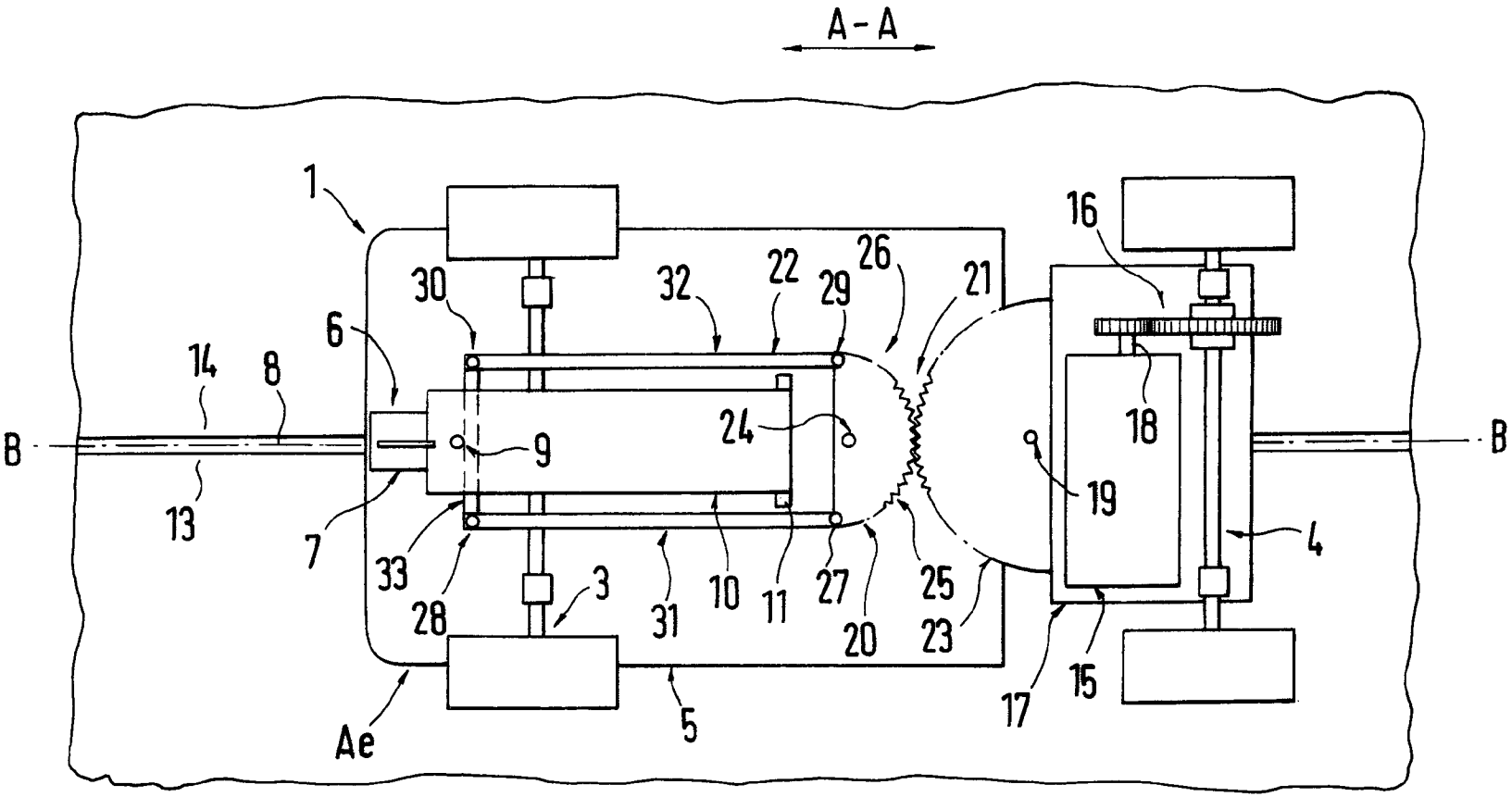
FIG. 1 is a plan view above a toy vehicle chassis in a first embodiment of the present invention.

A toy vehicle 1 according to a first embodiment designated generally by reference letters Ae is constructed for track-guided operation on a raceway 2 comprised of preassembled track sections and has a chassis 5 carried by a front axle 3 and a rear axle 4. A guide device or wedge 7 which is pivotable about a first vertical pivot axle 9 and cooperates with a groove 8 in the raceway 2 is provided in the front area 6 of the chassis 5. The guide device wedge 7 can be mounted on a pivot arm 10, which is connected via an articulated joint, to pivot bearings 11, 12 running or extending across the longitudinal direction A-A of the vehicle and current rails 13, 14 of current consumers cooperating with the raceway 2 may be provided. An electric motor 15 for driving the toy vehicle is installed in the chassis 5 between the front axle 3 and the rear axle 4 and adjacent to the latter. The electric motor 15 and the rear axle 4 are assembled via a gear transmission 16 to form an assembly designated generally by numeral 17, whereby the electric motor 15, connected to the current consumers, and its drive shaft 18 are aligned or extend across the longitudinal direction A-A of the vehicle.

The assembly 17 is pivotable about a second vertical pivot axle 19 and is operatively connected via a control unit 20 to the guide device or wedge 7, which is in turn hinge-connected to the chassis 5. Control unit 20 comprises a gear transmission 21 and a lever mechanism 22. The gear transmission 21 has a first tooth element 23 mounted on the second pivot axle 19 and a second tooth element 25 rotatable about a third vertical pivot axle 24. The two cooperating tooth elements 23, 25 have an approximately semicircular shape. The second tooth element 25 is mounted on a receptacle section 26 of the chassis 5 located next to the second pivot axle 19. In addition, the lever mechanism 22 having four articulated joints 27, 28, 29 and 30 is operative between the second tooth element 25 and the guide device or wedge 7.

The lever mechanism 22 is provided with two longitudinal control arms 31, 32 guided away from the second tooth element 25, and running along the longitudinal direction A-A of the vehicle. These longitudinal control arms 31, 32 are coupled to a transverse control arm 33 of the guide device or wedge 7. The longitudinal control arms 31, 32 preferably run or extend at the same distance from a central longitudinal plane B-B of the chassis 5.

Figure 3:
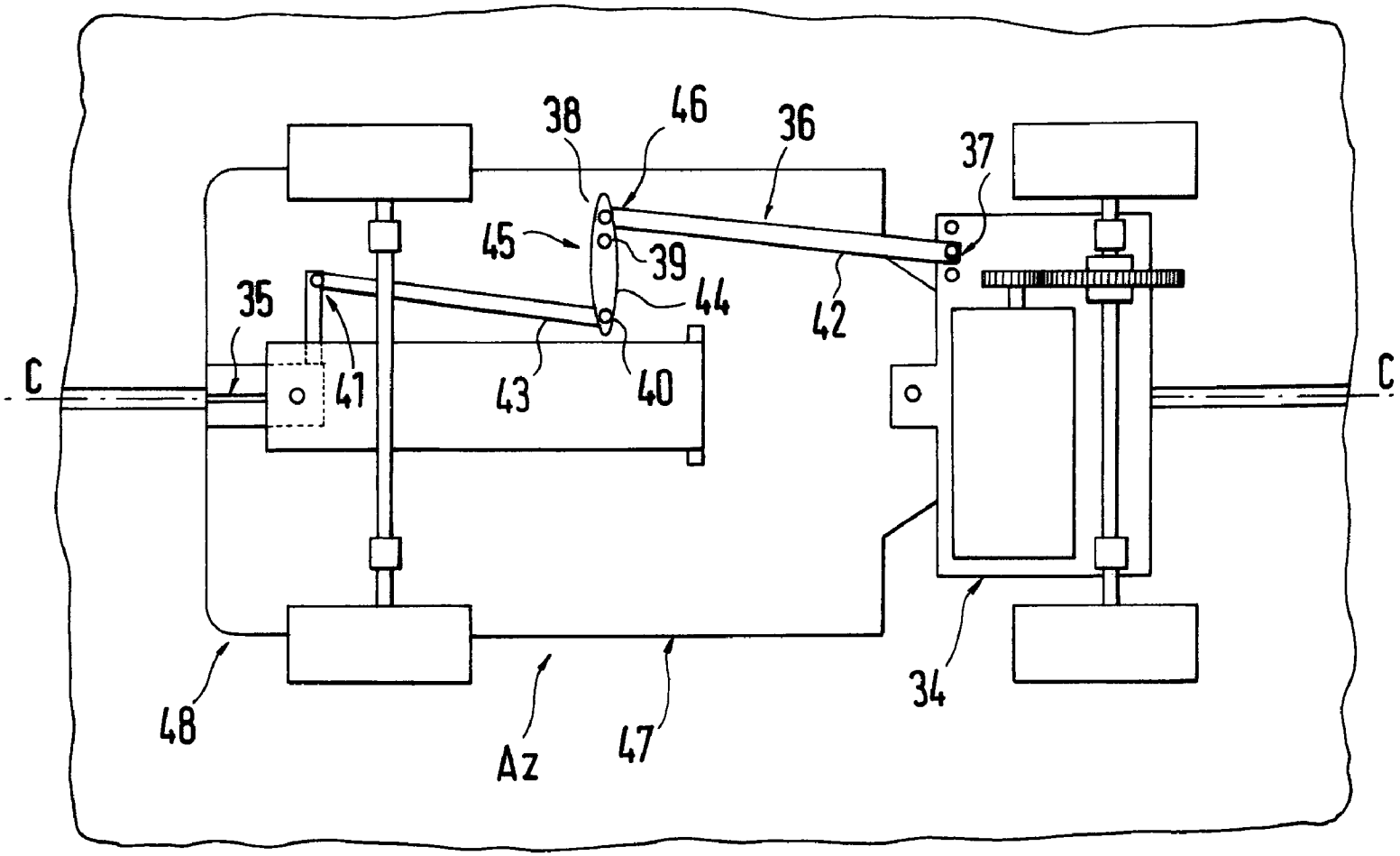

According to a second embodiment designated generally by the reference letter Az depicted in FIG. 3, a lever mechanism 36 having five articulated joints 37, 38, 39, 40 and 41 is operative between an assembly 34 and a guide device or wedge 35. The lever mechanism 36 has a first longitudinal control arm 42 connected to the assembly 34 and a second longitudinal control arm 43 connected to the guide wedge 35. The longitudinal control arms 42, 43 are connected to a two-armed transverse control arm 44 between the assembly 34 and the guide wedge 35. The transverse control arm 44 is movable about a fourth vertical pivot axle 45 mounted on a receptacle section 46 of a chassis 47 of a toy vehicle 48. Finally, the lever mechanism 36 runs outside of a central longitudinal plane C-C of the chassis 47.

Figure 2:
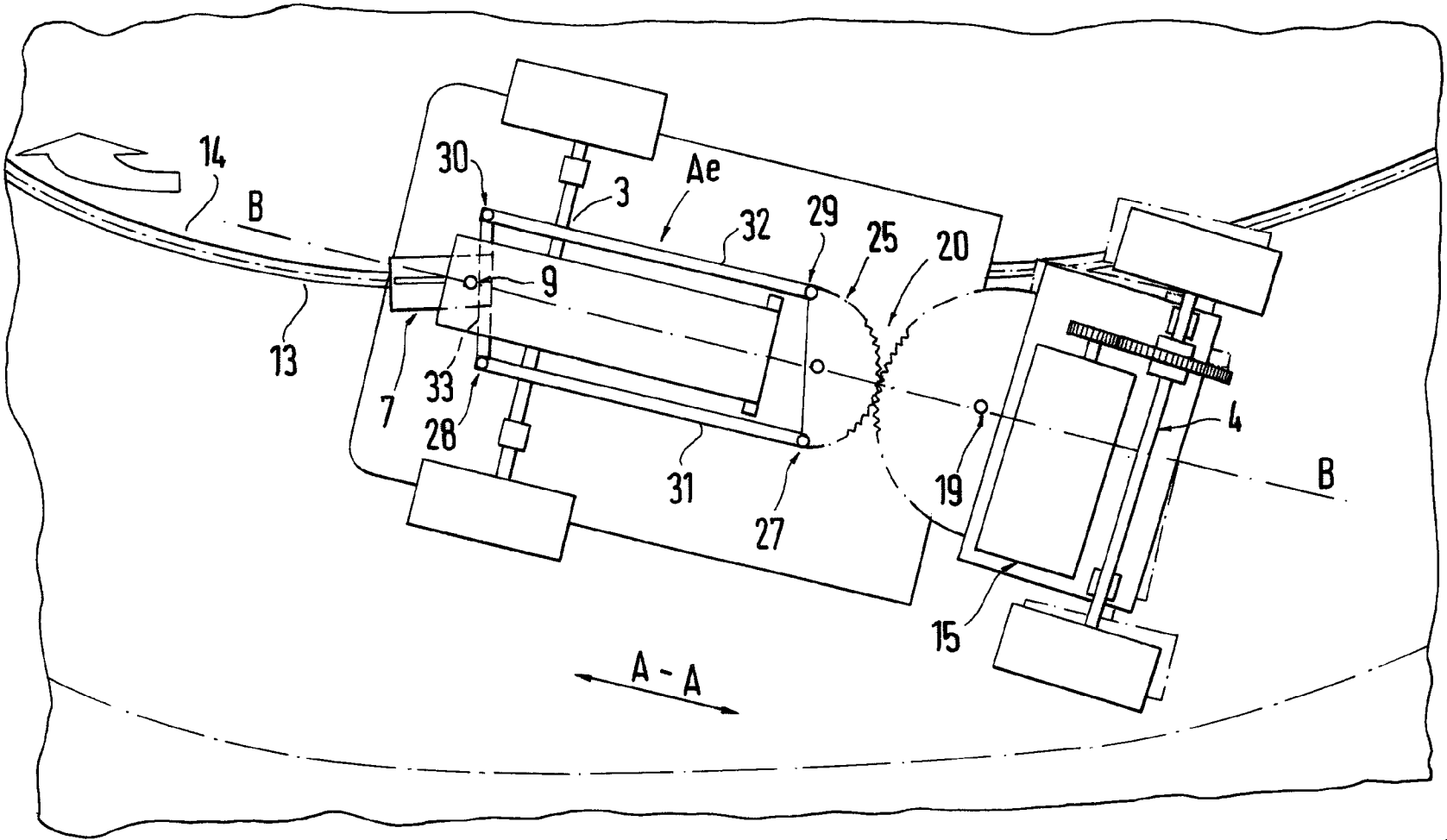
FIG. 2 is a view of the chassis in FIG. 1 but showing a steering function of the toy vehicle in a curve, FIG. 3. shows a view similar FIG. 1 but showing another embodiment of the chassis.
Figure 4:
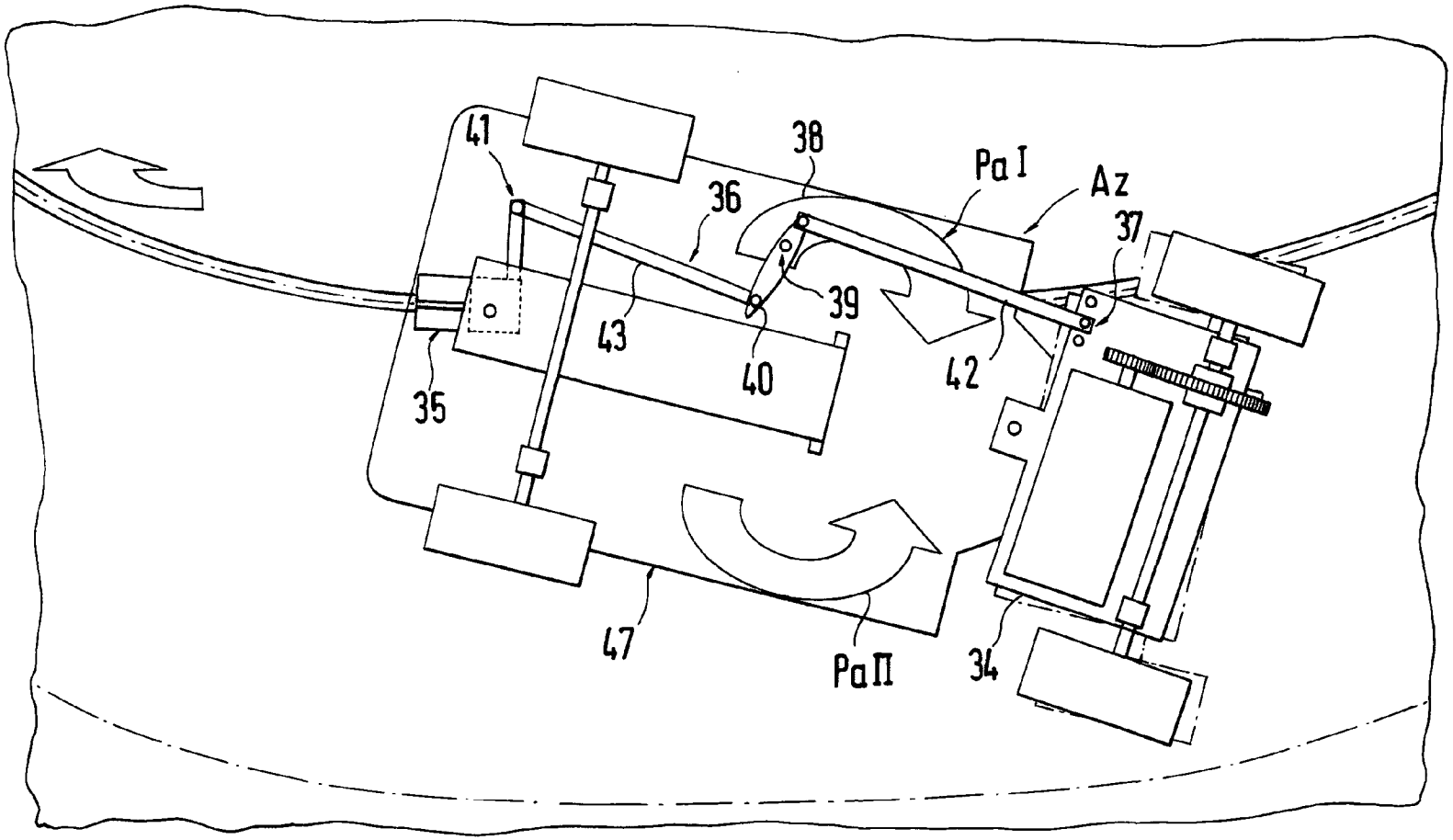
FIG. 4 shows a view of the chassis in FIG. 3 but showing a steering function.

FIG. 2 illustrates the steering performance of the toy vehicle 1 according to the first embodiment Ae in turning, for example, to the right. There, the toy vehicle 1 is stabilized by toe-in steering reducing the oversteering tendency of the rear axle 4 which is ensured by the articulated mounting of the assembly 17, the gear transmission 21 and the lever mechanism 22. This also applies appropriately to a toy vehicle (second embodiment Az) according to FIGS. 3 and 4, which illustrate a torque rotating toward the outside of the curve indicated with the clockwise arrow PaI and a stabilizing counter-torque by steering the rear axle as indicated by the counterclockwise arrow PaII.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. Chassis arrangement for a track-guided toy vehicle, the chassis arrangement comprising:

a front axle;

a rear axle;

a pivot arm having electrical current consumers configured for contacting current rails of a raceway;

a control unit;

an electric motor driving only the rear axle; and a guide wedge mounted on said pivot arm, movable about a first vertical pivot axis and engaging in a groove in the raceway in a front area of the chassis arrangement;

wherein the rear axle and the electric motor together form an assembly, arranged to be movable about a second vertical pivot axis and operatively connected to the guide wedge via the control unit;

the control unit having a lever mechanism with five articulated joints, the lever mechanism configured to be operative between the assembly and the guide wedge, the lever mechanism further having a first longitudinal control arm operatively connected to the assembly, a second longitudinal control arm operatively connected to the guide wedge, and a two-armed lever transverse control arm, the first and second longitudinal control arms being connected to the two-armed lever transverse control arm.

2. Chassis as recited in claim 1, wherein the transverse control arm is configured to be movable about a third vertical pivot axis mounted on a receptacle section of the chassis arrangement.

3. Chassis arrangement as recited in claim 1, wherein the lever mechanism is arranged outside a central longitudinal plane of the chassis arrangement.

4. Chassis arrangement as recited in claim 1, wherein the two-armed lever transverse control arm is configured to be movable about a third vertical pivot axis mounted on a receptacle section of the chassis arrangement.

* * * * *